US006249302B1

(12) United States Patent
Sekiya

(10) Patent No.: US 6,249,302 B1
(45) Date of Patent: Jun. 19, 2001

(54) THERMAL PRINTING

(75) Inventor: Hiroaki Sekiya, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/558,618

(22) Filed: Apr. 26, 2000

(30) Foreign Application Priority Data

May 10, 1999 (JP) ..... 11-128974

(51) Int. Cl.[7] ..... B41J 2/32
(52) U.S. Cl. ..... 347/220
(58) Field of Search ..... 347/220, 222

(56) References Cited

FOREIGN PATENT DOCUMENTS

0386919 * 9/1990 (EP) ..... 347/220
5-185619 * 7/1993 (JP) ..... 347/220

* cited by examiner

*Primary Examiner*—Huan Tran
(74) *Attorney, Agent, or Firm*—Adams & Wilks

(57) ABSTRACT

A conventional thermal printer has had a structure in which a platen roller cannot be removed from a frame. Therefore, it has been necessary to insert a printing paper between a thermal head and the platen roller. Thus, it has been hard to load the printing paper. In order to solve the problem, there has been devised means for engaging the platen roller with the frame by the biasing force of the thermal head pressing the platen roller to forcibly lift up the platen roller, thereby removing the platen roller. However, there have been problems in that great operating force is required for the removal and the precision in a platen roller support position is low. A frame is provided with a slit (1*c*) having such a shape as to guide a bearing of a platen roller (2), and the bearing of a platen roller (2) is pushed against the slit by a lock arm using the biasing force of a pressure spring (8) for causing a thermal head (5) to come in press-contact with the platen roller (2). Consequently, the platen roller (2) is supported.

5 Claims, 9 Drawing Sheets

THERMAL PRINTING

BACKGROUND OF THE INVENTION

1. Field of the invention

The present invention relates to a printing apparatus and a mechanism for removably supporting a platen roller when a printer head is brought into press-contact with the platen roller to interpose printing paper between the printer head and the platen roller, and more particularly, the invention relates to a thermal printing apparatus (thermal printer) capable of enhancing operability for the loading of the printing paper, head cleaning and the like.

2. Description of the Related Art

A thermal printer is constituted to form an image on a thermal printing paper by using a thermal head.

FIG. 8 shows an example of the structure of a conventional thermal printer and a printing paper inserting path. A platen roller 2 is rotatably supported to a body frame 1 through a bearing (not shown), and a thermal head 5 is rotated and biased to come in press-contact with the platen roller 2 by the biasing force of a pressure spring 8. The thermal head 5 can be separated from the platen roller 2 to form a clearance between the thermal head 5 and the platen roller 2 at the time of the loading of the printing paper, maintenance such as head cleaning, and the like. The printing paper is inserted in the clearance and is thus loaded.

FIG. 9 is a side view illustrating a mechanism for removably supporting the platen roller which has a problem to be solved by the present invention. FIG. 9 shows an example of the structure of a mechanism for pushing a bearing 3 of the platen roller 2 against the body frame 1 by the pressing force of the thermal head 5, thereby engaging the platen roller 2. The platen roller 2 is provided across the body frame 1 of the printer rotatably and removably. A line type thermal head 5 fixed to the front face of a head support member 6 is biased to come in press-contact with the platen roller 2. The thermal head 5 is arranged almost vertically in the body frame 1. A portion 1*c* of the body frame 1 for engaging the platen roller 2 has the shape of a special slit in order to attach or remove the platen roller 2.

Referring to the structure in which the platen roller 2 cannot be attached to or removed from the body frame 1 as shown in FIG. 8, conventionally, there have been a method of bringing the tip of a printing paper to a contact point at which the thermal head 5 is in press-contact with the platen roller 2 and rotating the platen roller 2 to draw the printing paper for loading and a method of separating the thermal head 5 from the platen roller 2 and inserting the printing paper in the clearance formed therebetween. However, these methods require a user to know well how to handle the thermal printer. In particular, operability related to the insertion of the printing paper has had a big problem in that it is hard to grope for a printing paper insertion port in a dark environment, for example, at night. Moreover, in the case where maintenance such as head cleaning is to be carried out, an applicator or the like can be put in the clearance between the thermal head 5 and the platen roller 2. However, there has been a possibility that visual confirmation might be difficult and cleaning might be carried out insufficiently because of a small opening.

In order to solve these problems, there has been devised the structure in which the platen roller 2 can be completely attached to or removed from the body frame 1 as shown in FIG. 9. When the printing paper is to be loaded, the platen roller 2 is lifted up from the body frame 1 and is separated therefrom, the printing paper is dropped into the printer body and the platen roller 2 is then attached to the body frame 1 again as shown in FIG. 9. Thus, printing paper is loaded between the thermal head 5 and the platen roller 2. With such a structure, however, the platen roller 2 is engaged with the frame 1 by the biasing force of the thermal head 5 pressing the platen roller 2. The structure has low positioning precision for the platen roller 2. Moreover, a larger operating force is required for the attachment and removal of the platen roller 2. In the case where the platen roller 2 is not pushed into a predetermined position during the attachment of the platen roller 2, a friction is generated between the body flame 1 and the bearing 3 of the platen roller 2 by the pressing force of the thermal head 5 so that the platen roller 2 might be fixed into a position that is not the position specified. When the support position of the platen roller 2 is shifted, a driving mechanism is not operated normally. In some cases, a print failure is caused.

SUMMARY OF THE INVENTION

The present invention is proposed in order to solve the above-mentioned problems, and an object of the present invention is to provide a platen roller support mechanism for a thermal printer which has high reliability for the attachment and removal of the platen roller 2 to and from the body frame 1, which can easily load printing paper, and can which achieve a reduction in size.

In order to attain the above-mentioned object, the present invention is directed to a line dot type thermal printer in which a lock arm carrying a bearing of a platen roller is provided and the bearing of the platen roller is sandwiched between a slit formed on a body frame and the lock arm by the biasing force applied to the lock arm. Consequently, the platen roller is supported in a predetermined position. The slit has such a shape as to guide the bearing of the platen roller to the predetermined position with respect to the frame. The biasing force applied to the lock arm is generated by using a pressure spring for causing the thermal head to come in press-contact with the platen roller.

The present invention according to one feature relates to the shape of a slit of the frame into which the bearing of the platen roller slides and is characterized in that the slit having the shape of a slope is formed on the body frame in a direction in which the thermal head presses the platen roller. At the same time that the lock arm releases the constraint of the bearing of the platen roller, the thermal head presses the platen roller and lifts up the platen roller by using the slope. Consequently, the platen roller can be separated from the frame. Moreover, also in the case where the amount of operation of the lock arm is insufficient as shown in FIG. 4, the bearing of the platen roller is set to a predetermined position along the slope again by the biasing force.

The present invention according to another feature is characterized in that the lock arm is provided with a cam face for causing the lock arm to further push up the bearing of the platen roller after the platen roller has been lifted up by the thermal head. By completely removing the platen roller from the body frame, a user's operability can be enhanced.

The present invention according to a further feature is characterized in that the operation of the lock arm is carried out by the cam supported to the body frame. By attaching, to the cam, an operating portion having various shapes such as a lever, light and reliable operation can be carried out. Thus, the present invention can be applied to a wide range of uses.

The present invention according to another feature solves the problem related to the mechanism according to the present invention. When the platen roller to be removed is depressed from above by other external force and the lever is operated at that time, the pressure spring is greatly deformed. In order to prevent such a situation, a stopper for interfering with a head support member is provided on the lock arm.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

A preferred embodiment of the present invention will be described below in detail with reference to the drawings.

Figure 1:
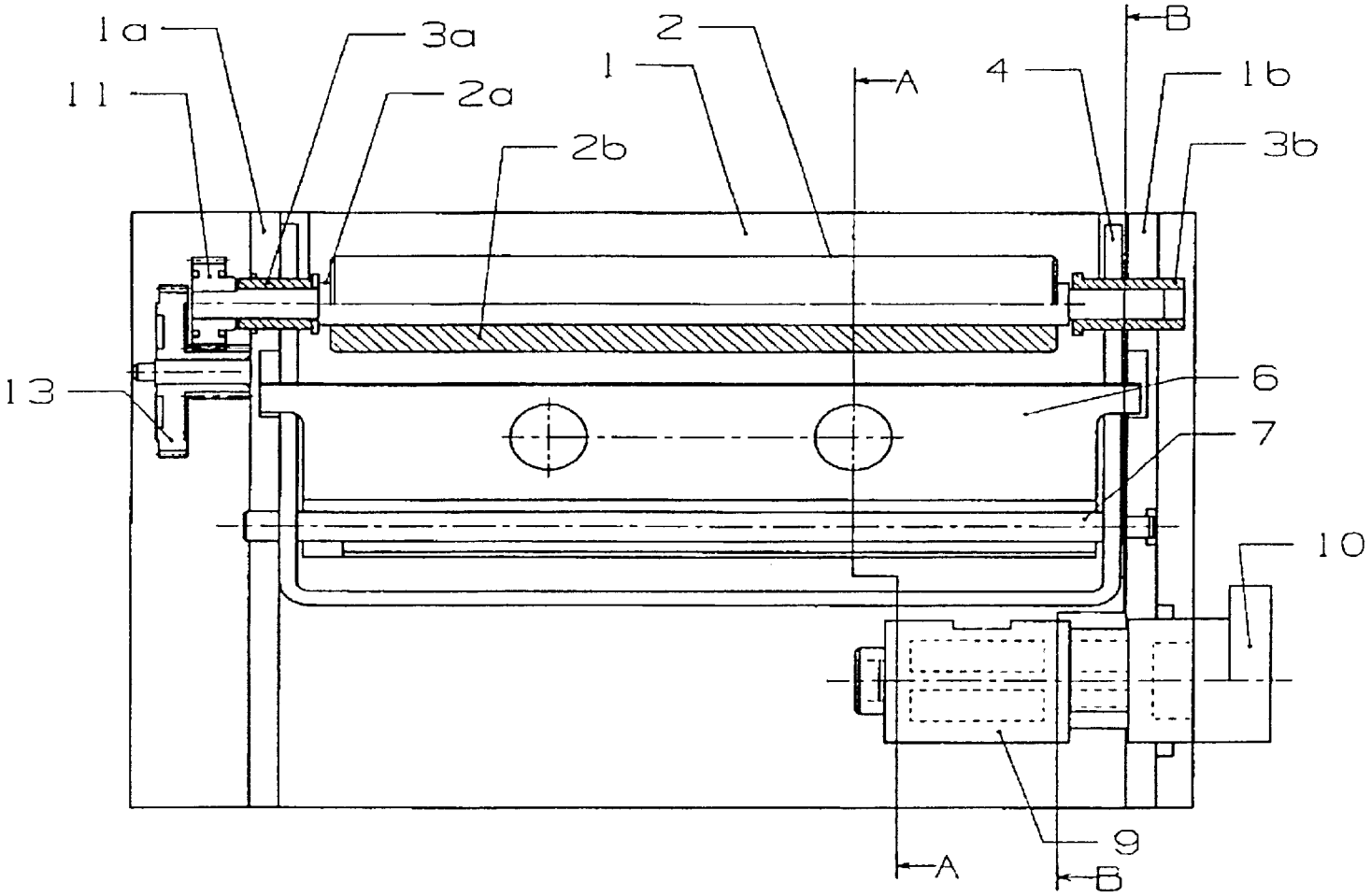
FIG. 1 is a partially sectional plan view showing a thermal printer according to an embodiment of the present invention.
Figure 2:
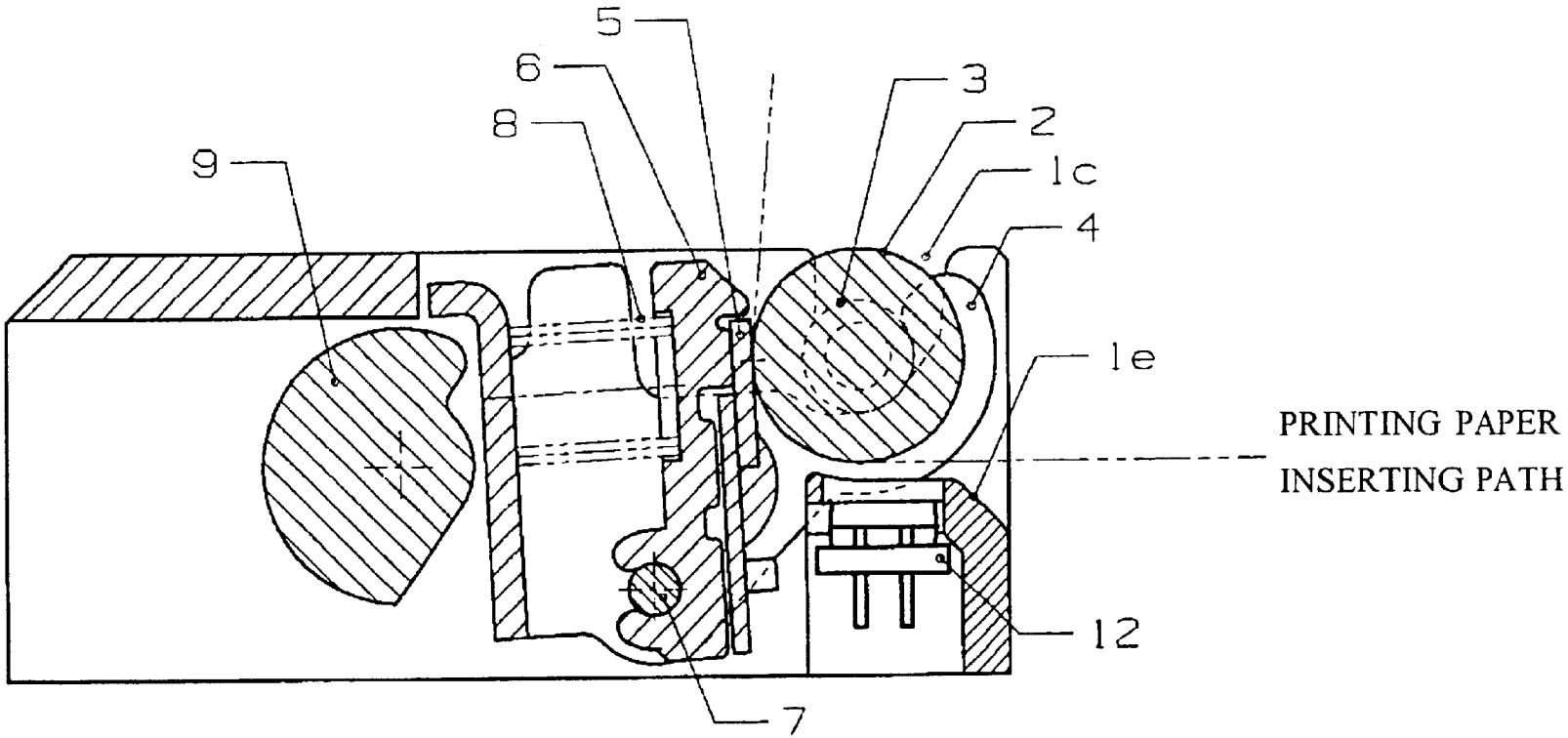
FIG. 2 is a side view taken along the line A—A in FIG. 1.

FIG. 1 is a partially sectional plan view showing an embodiment of the present invention, FIG. 2 is a side view taken along the line A—A in FIG. 1, and FIGS. 3 to 7 are side views taken along the line B—B in FIG. 1. These drawings are sectional views showing a main part in order to plainly illustrate the characteristic structure of a thermal printer according to the embodiment which will be described below. Moreover, FIG. 2 to FIG. 7 are not full sectional views but partially perspective and side views in order to easily represent the state in which a lock arm 4, a platen roller 2 and a thermal head 5 and a head support member 6 interact with one another and to prevent the drawings from being complicated.

In FIG. 1, the platen roller 2 is provided between side walls 1*a* and 1*b* of a body frame 1 of the printer. The body frame 1 is formed of plastic, and the platen roller 2 includes a shaft 2*a* and a friction roller 2*b* attached to the shaft 2*a* and formed of a cylindrical elastic member. The shaft 2*a* has both ends supported rotatably by a slit 1*c* shown in FIG. 2 which is formed on the side walls 1*a* and 1*b* of the body frame 1 and by bearings 3*a* and 3*b* of the platen roller 2 which are fitted in the lock arm 4 and are almost cylindrical. The slit 1*c* has such a shape as to guide the bearings 3*a* and 3*b* of the platen roller 2 in predetermined positions with respect to the frame. A rotatable driving motor (not shown) is fixedly attached to the side wall 1*a* of the body frame 1. The rotation motion of the rotatable driving motor is transmitted from a reduction gear 13, which is provided on the side wall 1*a* of the body frame 1 and which is partially shown, to a platen driving gear 11 attached to one of ends of the shaft 2*a*. Consequently, the platen roller 2 is driven and rotated.

As shown in FIG. 2, a guide face 1*e* for smoothly feeding a thermal paper as a printing paper is formed in the lower portion of the front end of the body frame 1. A printing paper detecting device 12 including a photointerrupter or the like is embedded in a part of the guide face 1*e*.

The line dot type thermal head 5 is fixed to the front face of the head support member 6 and is arranged in parallel with the platen roller 2. The head support member 6 is attached to the lock arm 4 such that they can approach or separate from each other by using a support shaft 7 as the center of rotation. Furthermore, a pressure spring 8 is attached to bias the head support member 6 and the lock arm 4 to separate from each other.

The pressure spring 8 gives biasing force for engaging the bearing 3 of the platen roller 2 between the lock arm 4 and the slit 1*c* of he body frame 1, and also serves as biasing force for causing the thermal head 5 to come in press-contact with the platen roller 2 as shown in FIG. 2 in the state in which the bearing 3 of the platen roller 2 is engaged between the slit 1*c* of the body frame 1 and the lock arm 4.

In this embodiment, a cam 9 for disengaging the bearing 3 of the platen roller 2 from the lock arm 4 and a lever 10 fixed to the cam 9 for operating the cam 9 are rotatably attached to the body frame 1.

Figure 3:
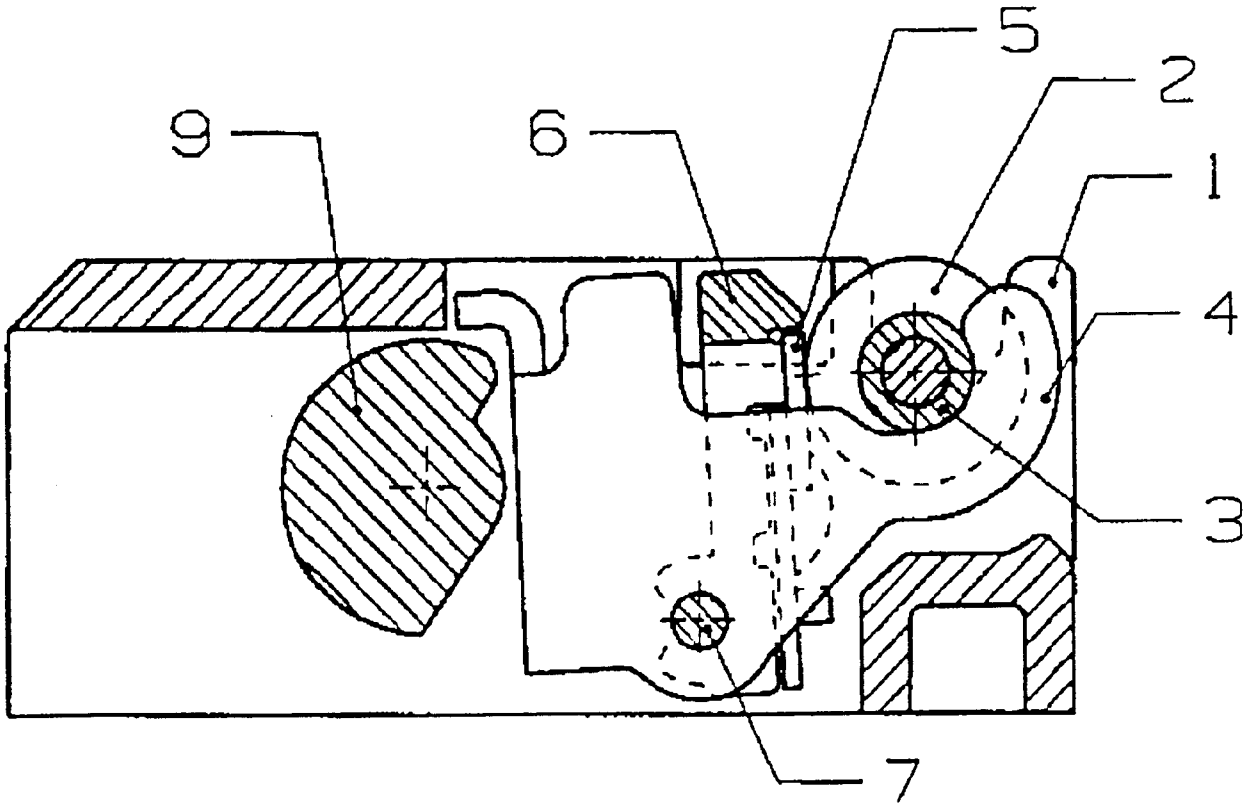
FIG. 3 a side view taken along the line B—B in FIG. 1.
Figure 4:
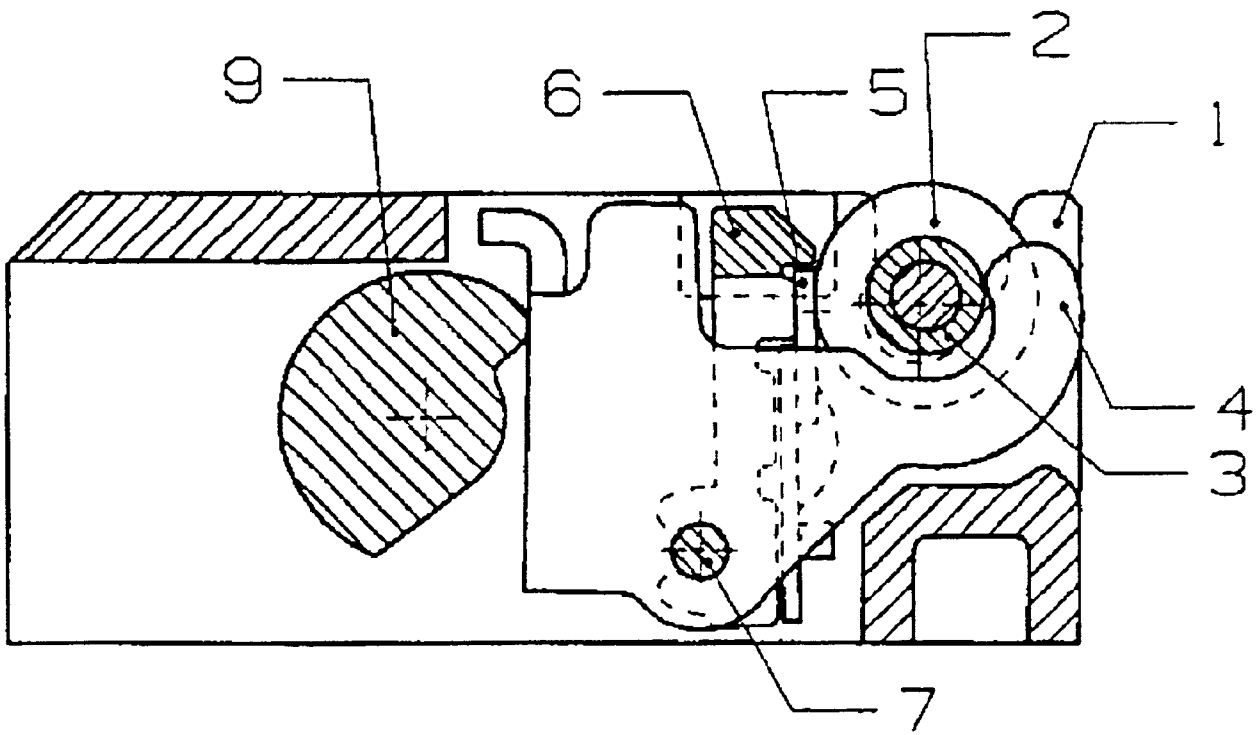
FIG. 4 is a side view illustrating the process of a forced release mechanism corresponding to FIG. 2.
Figure 5:
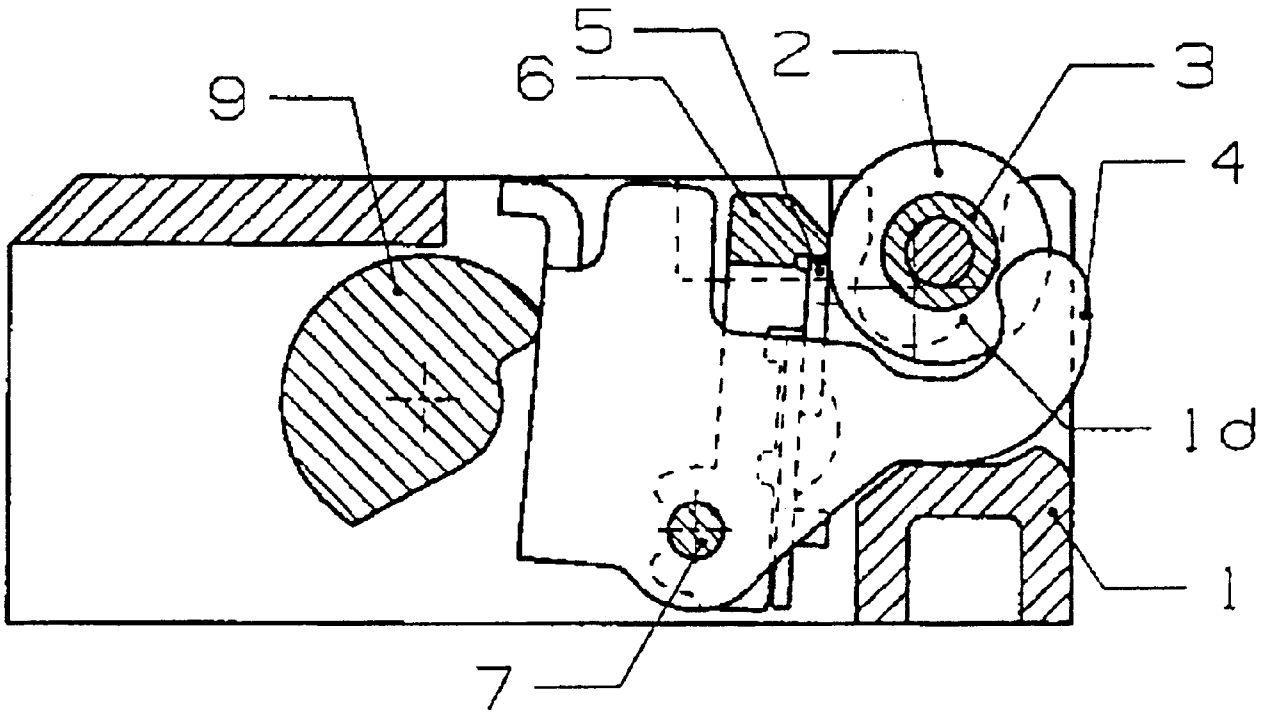
FIG. 5 is a side view illustrating the time of the end of a forced release corresponding to FIG. 2.

Description will be given below of the operation of the cam 9 and the lever 10 for disengaging the bearing 3 of the platen roller 2 from the lock arm 4. In FIG. 3, when the lever 10 (not shown) is rotated clockwise with the bearing 3 of the platen roller 2 engaged in a predetermined position, the cam 9 integrated with the lever 10 is also rotated clockwise, the lock arm 4 is pressed by the cam 9 and is rotated clockwise around the support shaft 7 as shown in FIGS. 4 and 5 so that the bearing 3 of the platen roller 2 is disengaged. At that time, the lock arm 4 is rotated to approach the head support member 6. Therefore, the thermal head 5 presses the platen roller 2 by the biasing force of the pressure spring 8 and the bearing 3 of the platen roller 2 is pushed up by a slope 1*d* provided in the slit 1*c* of the body frame 1.

Figure 6:
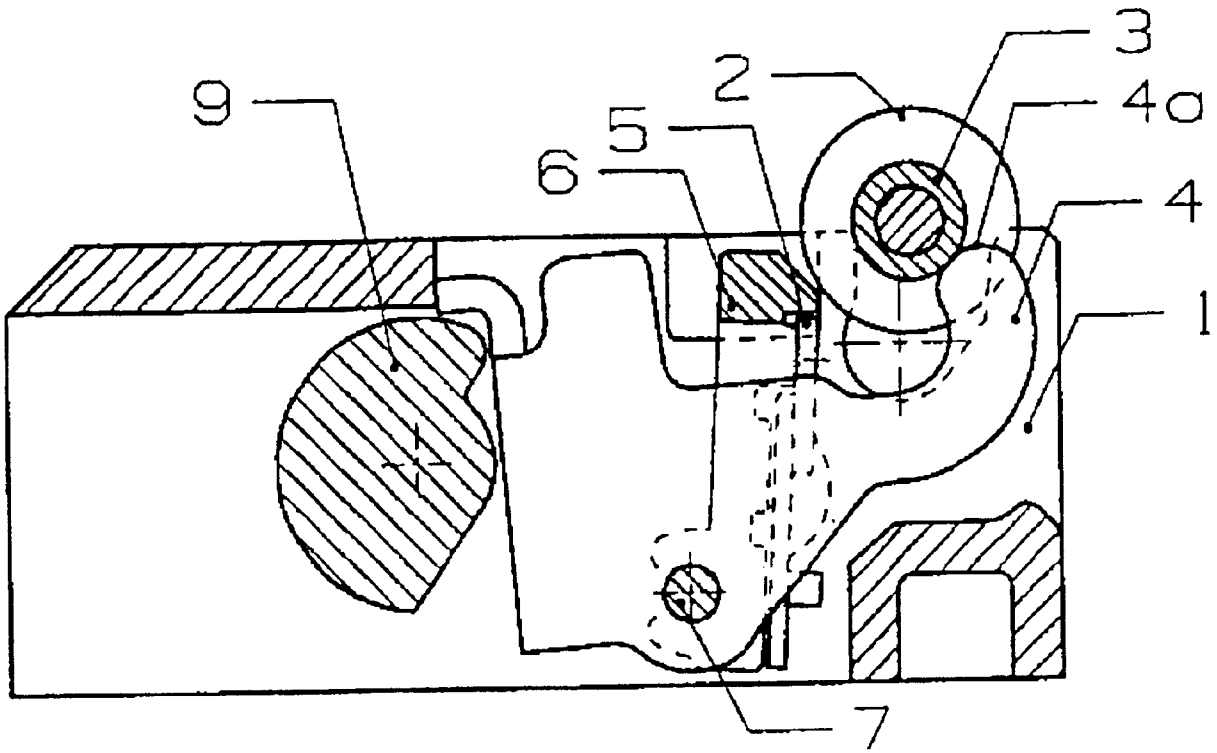
FIG. 6 is a side view illustrating the removal of a platen roller from a body frame after the end of the forced release shown in FIGS. 4 and 5.

Furthermore, when the lock arm 4 is returned counter-clockwise by the biasing force of the pressure spring 8 after the end of the forced release, the bearing 3 of the platen roller 2 runs up on to a cam face 4*a* provided on the lock arm 4 as shown in FIG. 6 so that the platen roller 2 is completely removed from the body frame Next, the operation for setting the platen roller 2 to the body frame 1 will be described. When the bearings 3*a* and 3*b* of the platen roller 2 are pushed downward in the state shown in FIG. 6, they rotate the lock arm 4 clockwise around the support shaft 7, slide into the slit 1*c* and are fixed by the biasing force of the lock arm 4 which is generated by the pressure spring 8. During the setting, the operation of the lever 10 is not required.

Figure 7:
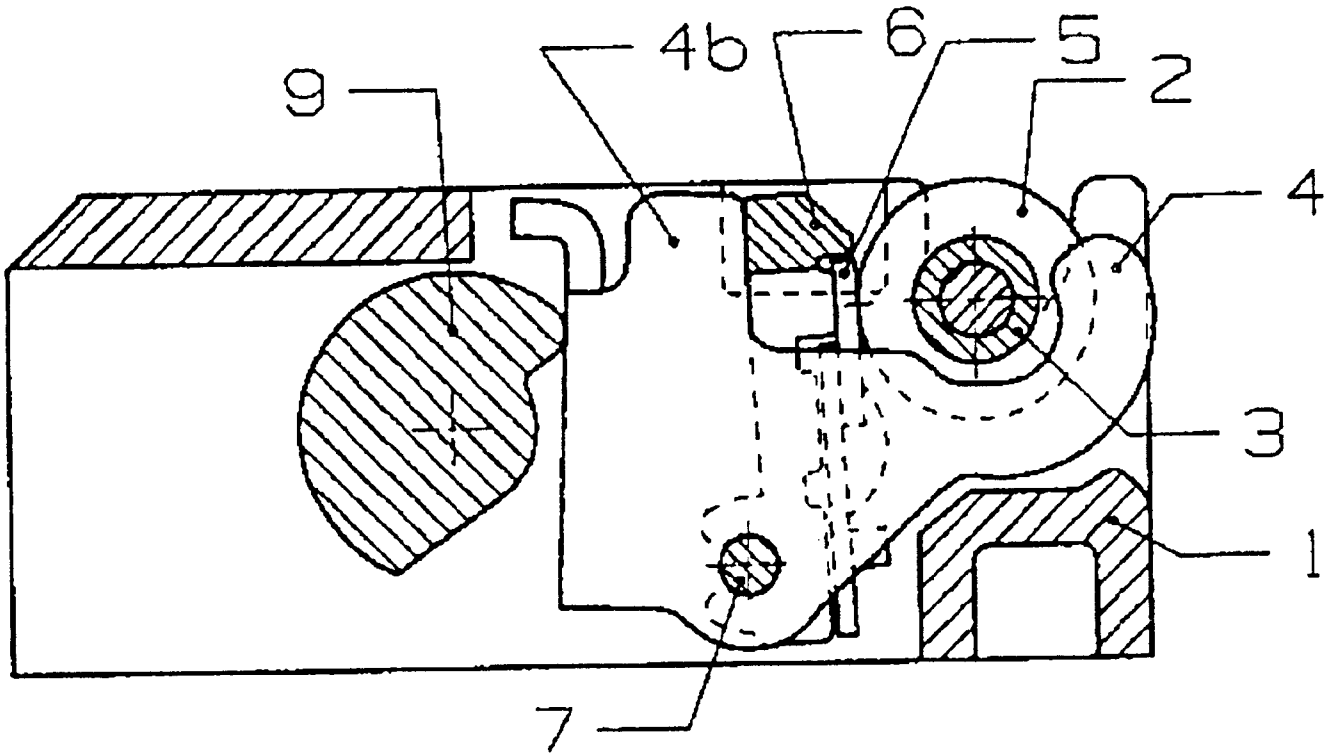
FIG. 7 is a side view illustrating a feature of preventing a pressure spring from being excessively deformed in FIG. 2.
Figure 8:
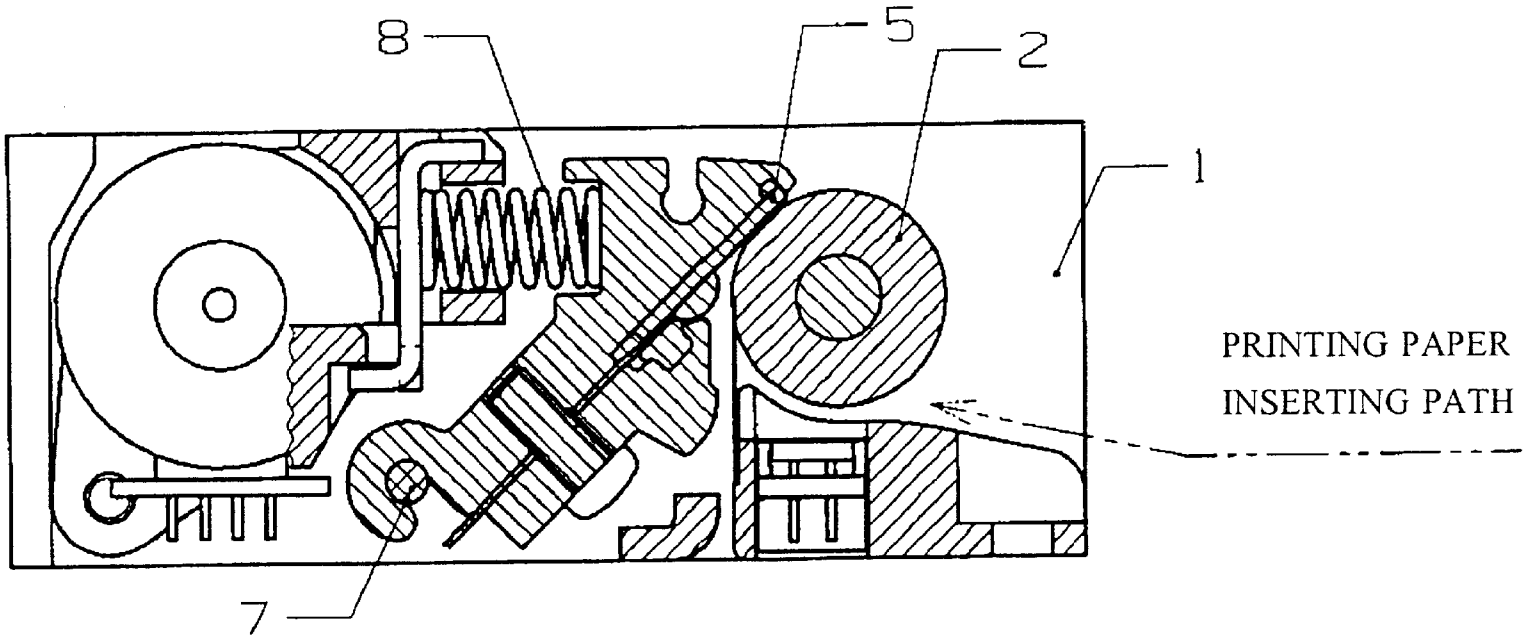
FIG. 8 PRIOR ART
FIG. 8 is a sectional side view showing an example of the structure of a conventional thermal printer and a recording paper inserting path.
Figure 9:
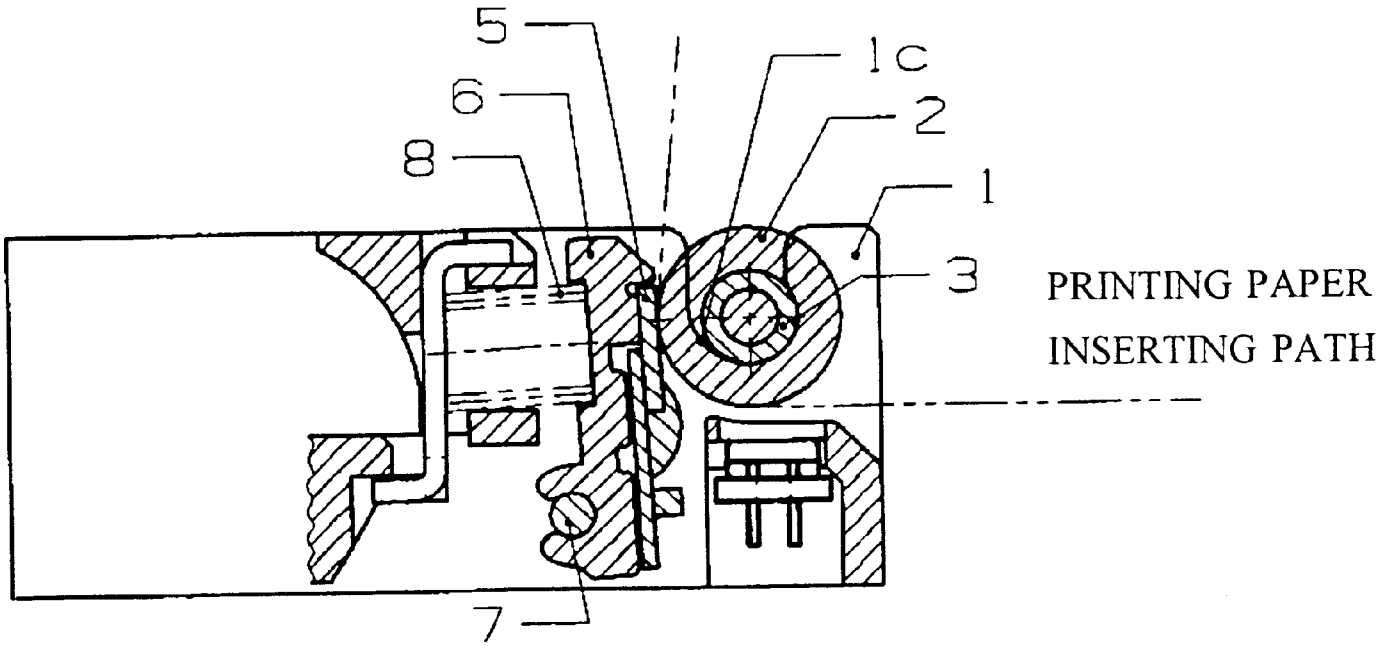
FIG. 9 PRIOR ART
FIG. 9 is a side view illustrating a platen roller support mechanism which has a problem to be solved by the present invention.

In the case where the forced release is carried out with the bearing 3 of the platen roller fixed to the body frame 1, a stopper 4*b* provided on the lock arm 4 interferes with the head support member 6 to regulate the rotation as shown in FIG. 7. Consequently, it is possible to prevent the pressure spring 8 from being excessively deformed.

According to the platen roller support mechanism for the thermal printer of the present invention described above, the platen roller can be supported with high positioning precision by means of the lock arm for biasing and carrying the bearing of the platen roller between the lock arm and the slit provided on the frame. The platen roller can be completely removed from the body frame by means of the slope provided on the slit of the frame and by means of the cam face provided on the lock arm. Consequently, the platen roller can be attached or removed with high reliability. Furthermore, the operation is carried out by means of the lever having high operability. Therefore, the printing paper can be loaded easily and operability can be enhanced for a paper jam, maintenance such as head cleaning and the like.

What is claimed is:

1. A thermal printer comprising:

a body frame;

a line dot type thermal head and a head support member provided integrally with a back face thereof;

a platen roller provided in parallel with the thermal head; and a lock arm for supporting a bearing of the platen roller, the bearing allowing the platen roller to freely rotate;

wherein the bearing of the platen roller is carried by the lock arm and a slit which has such a shape as to guide, into predetermined positions, the bearing of the platen roller is provided on a side wall of the body frame, and wherein the lock arm pushes the bearing of the platen roller against the frame by utilizing biasing force of a pressure spring for pressing the thermal head.

2. A thermal printer according to claim 1, wherein the slit of the body frame is provided with a slope shape in a direction in which the thermal head presses the platen roller, and wherein the thermal head pushes up the platen roller by using the slope provided on the slit of the frame as the lock arm is moved away.

3. A thermal printer according to claim 1, wherein when the lock arm is returned by the biasing force of the pressure spring after the thermal head pushes up the platen roller, the bearing of the platen roller is further pushed upward to completely remove the platen roller from the body frame by a cam face formed on an edge of the lock arm.

4. A thermal printer according to claim 1, wherein the lock arm is operated by the cam integrated with a lever provided outside the side wall of the body frame.

5. A thermal printer according to claim 1, 2, or 3, wherein the lock arm is provided with a stopper for interfering with the head support member before the pressure spring is excessively deformed even if the lever is operated with the platen roller depressed so as not to be removed.

* * * * *